US005560274A

United States Patent [19]

Turner

[11] Patent Number: 5,560,274

[45] Date of Patent: Oct. 1, 1996

[54] MANUAL TILE CUTTER

[75] Inventor: Brian Turner, Walton, Ky.

[73] Assignee: North American Tile Tool Company, Burlington, Ky.

[21] Appl. No.: 306,767

[22] Filed: Sep. 15, 1994

[51] Int. Cl.[6] ..... B26D 3/08; B28D 1/22

[52] U.S. Cl. ..... 83/886; 125/23.02; 225/96.5

[58] Field of Search ..... 225/96, 96.5, 94, 225/103; 30/164.9, 164.95; 125/23.01, 23.02; 83/881, 886

[56] References Cited

U.S. PATENT DOCUMENTS

| | | | |
|---|---|---|---|
| 1,552,546 | 9/1925 | Smith | 83/886 |
| 4,026,262 | 5/1977 | Yasuga . | |
| 4,084,569 | 4/1978 | Chrismas . | |
| 4,192,282 | 3/1980 | Fischer . | |
| 4,378,782 | 4/1983 | Richard et al. . | |
| 5,040,521 | 8/1991 | Pourtau et al. . | |
| 5,169,045 | 12/1992 | Liu . | |

FOREIGN PATENT DOCUMENTS

| | | | |
|---|---|---|---|
| 592345 | 4/1994 | European Pat. Off. | 125/23.01 |
| WO9323216 | 11/1993 | WIPO . | |

*Primary Examiner*—Eugenia Jones
*Assistant Examiner*—Charles Goodman
*Attorney, Agent, or Firm*—Wood, Herron & Evans, P.L.L.

[57] ABSTRACT

A manually operated tile cutter having a carriage slidably mounted on a pair of guide rails supported by a base. An operating lever is pivotally connected to the carriage at a point below the guide rails, and the carriage contains two interconnected operating lever pivot supports which position the scoring wheel at different heights thereby accommodating different tile thicknesses.

11 Claims, 3 Drawing Sheets

FIG. 1
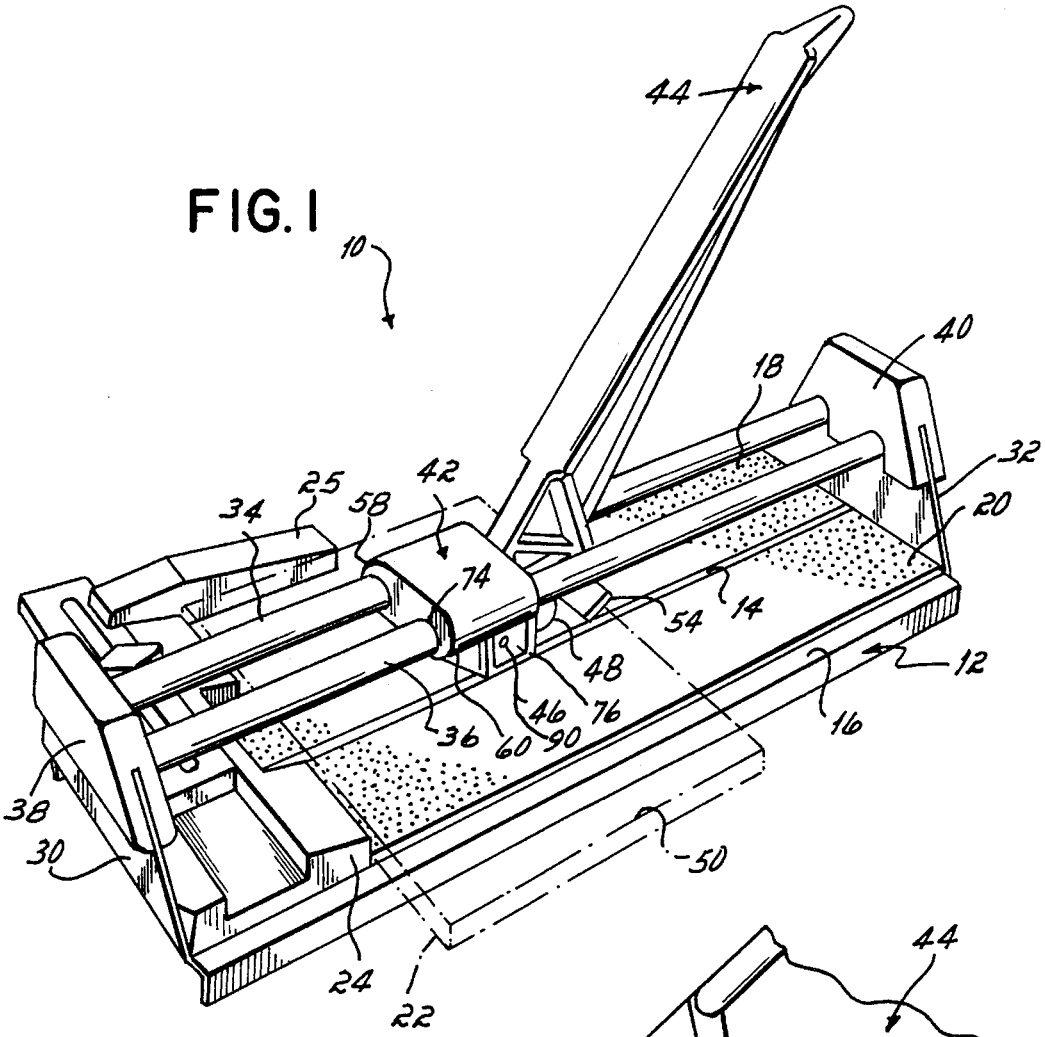
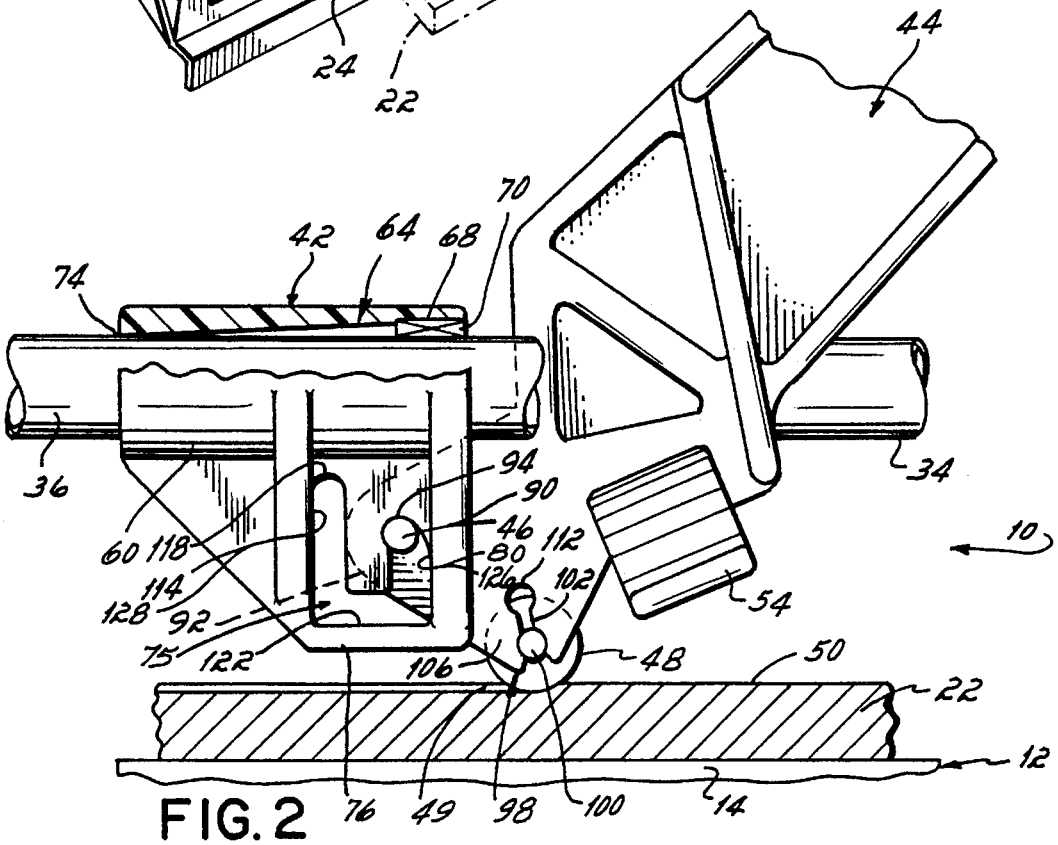
FIG. 2

MANUAL TILE CUTTER

BACKGROUND OF THE INVENTION

The present invention relates generally to tile cutters and, more particularly, to a tile cutter having one end of a lever arm operatively connected to a sliding carriage at a point below the guide rails supporting the carriage; and the carriage supports the one end of the lever arm at different elevations so that the height of a tile scoring tool may be adjusted to different tile thicknesses.

With a conventional manual tile cutter, a cutting or scoring tool is operatively connected to a handle which slides along a guide bar so that the cutting tool or cutting wheel is moved across the tile surface along a line defining where the tile is to be cut or broken. The cutting tool cuts into the surface of the tile along the desired line, thereby providing a shallow groove or score line in the tile surface. The base has a longitudinally generally centrally spaced breaker bar or edge thereon on which the tile rests. Resilient pads also support the tile on either side of the breaker bar. After the tile is scored, the manual lever arm is manipulated to place pressure pads or plates against the surface of the tile on both sides of the scored line, which is located directly over the breaker bar. As downward pressure is applied to the handle, the pressure plates apply downward forces on the top surface of the tile on both sides of the breaker bar. Continued application of the force is effective to cause the tile to break into two pieces, preferably at a location defined by the score line or groove.

Conventional manual tile cutters are of two general constructions. A first construction is shown in the Ishii U.S. Pat. No. 5,303,690. With that construction, one or more guide bars are supported a predetermined distance above a base which has a centrally located longitudinal breaker bar for supporting the tile. A slider or carriage is slidably mounted to the guide bar(s), and a manually operated lever is pivotally attached to the slider at a point above the guide bar(s). The scoring wheel is pivotally attached to the slider at a point below the guide bar(s), and intermediate linkage is connected between the manually operated lever and the scoring wheel link. The lever is moved to locate the scoring wheel on the tile surface and subsequently locate the pressure plates upon the upper tile surface in order to apply pressure and break the tile over the breaker bar. Such a compound lever construction has the disadvantage of being relatively complex and expensive to manufacture and requires various and numerous pivot pins and pivot joints in order to provide the necessary scoring and breaking action.

A second general construction for a manual tile cutter is illustrated in the Yasuga U.S. Pat. No. 4,026,262. The tile cutter in Yasuga '262 patent is simplified by slidably mounting the manually operated lever directly to a single rail. While that construction is simpler and less expensive to manufacture, it is important that the tile cutter scribe a scoring line that is straight, and that the mechanism be sufficiently rigid to allow the scoring wheel to be placed in the same location and repeatedly track over the same scoring line. The construction of the Yasuga' 262 patent is typically not as rigid or stiff as a construction utilizing a separate carriage on one or more guide bars. Therefore, the construction has the disadvantage of being less able to score the desired straight line in the first instance and repeatedly score over the same line.

The tile cutter of Yasuga '262 patent has a scoring wheel rotatably connected to the end of a pivot arm which is pressed against an elliptical cam. By rotating the elliptical cam, the scoring wheel is moved to different heights relative to the base, thereby accommodating different tile thicknesses. The tile cutter construction of the Yasuga '262 patent has a disadvantage in that the forces applied to the scoring wheel during the scoring process are in turn applied to the elliptical cam at a point offset from the center of the cam. Further, those forces will have a tendency to rotate the cam and change the cutter height unless the cam is very firmly locked into its rotational position.

SUMMARY OF THE INVENTION

To overcome the disadvantages described above, the present invention provides a manually operated tile cutter of the guide rod and slider construction wherein the scoring wheel is an integral part of the manually operated lever, thereby simplifying its construction. Further, the scoring wheel is readily adjustable to different fixed heights to accommodate different tile thicknesses.

According to the principles of the present invention, and in accordance with the described embodiments, the tile cutter includes a base having a centrally located longitudinal cutting bar for supporting the tile. At least one guide rail is rigidly connected to and located above the base in a direction parallel to the longitudinal breaker bar. A carriage is slidably mounted on the guide rail and includes a first fulcrum support located below the rail. A manually operated lever has a fulcrum at one end which is pivotally engaged with the first fulcrum support of the carriage at a point below the guide rail. A scoring wheel is rotatably mounted to the lever at the one end at a point below the fulcrum and between the fulcrum and the opposite end of the lever. The lever is manipulated to move the fulcrum on the lever in contact with the first fulcrum support on the carriage so that the cutting tool scores a tile within a first range of tile thickness. The above construction has the advantage of providing the rigidity and stability of a carriage and guide rail construction. Further, by placing the pivoting connection between the lever and carriage at a point below the guide rail, the cutter has a further advantage of providing a more consistent and cleaner scoring action on the upper surface of the tile. In addition, the integral construction of the cutting tool and the lever provides a simpler, more reliable, and less expensive construction.

In accordance with a further invention in the tile cutter, the carriage includes a second fulcrum support below the guide rail for receiving and supporting the fulcrum on the lever. The second fulcrum support is located at a height above the base which is less than the height of the first fulcrum support. The lever fulcrum is easily moved from the first fulcrum support to the second fulcrum support, thereby providing a cutting tool height which accommodates a second range of tile thickness. The first and second fulcrum supports on the carriage are at two different physical locations and present positive stops and supports for the fulcrum on the lever. Consequently, that construction rigidly supports the fulcrum on the lever without the potential of sliding or moving and, therefore, provides the advantage of maintaining a constant cutter height regardless of the magnitude of the forces applied to the lever.

These and other objects and advantages of the present inventions will become more readily apparent during the following detailed description together with the drawings.

BRIEF DESCRIPTION OF THE DRAWINGS

FIG. 1 is a perspective view illustrating a preferred embodiment of the tile cutter including the present inventions.

FIG. 2 is a side view in partial cross-section illustrating one end of the lever operably connected to the carriage at a first height.

DETAILED DESCRIPTION OF THE INVENTION

Figure 3:
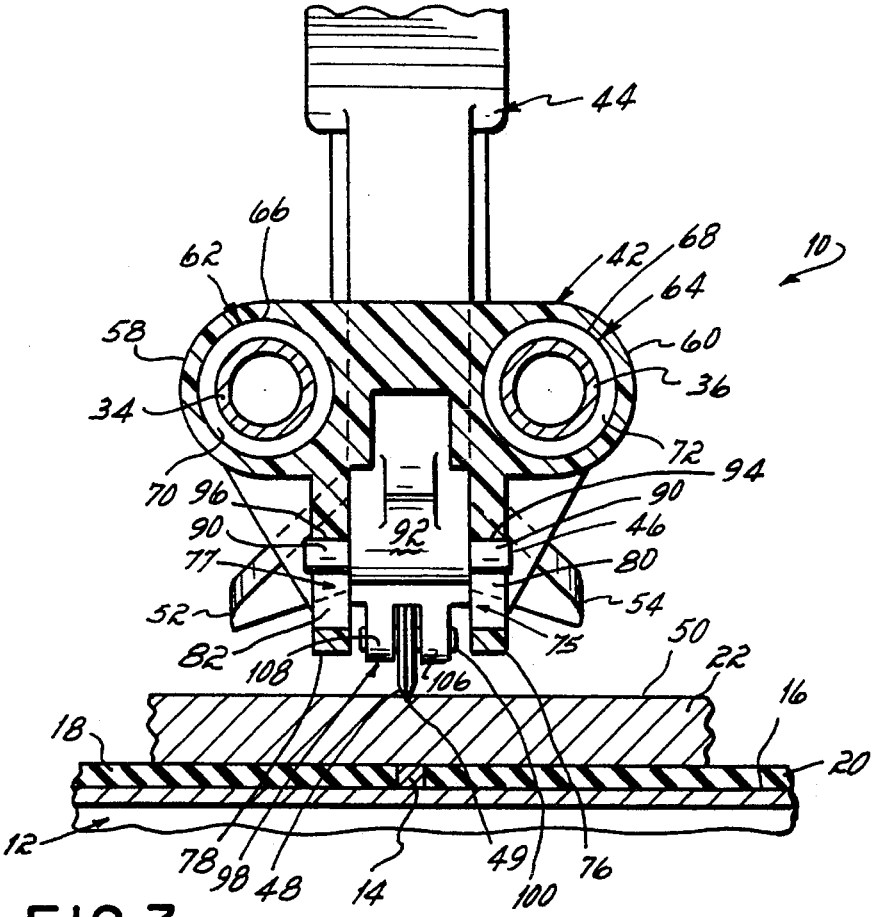
FIG. 3 is a partial cross-sectional end view of the tile cutter illustrating the pivotal connection of the lever to the carriage.

Referring to FIG. 1, a tile cutter 10 is comprised of a generally rectangular base 12 which has a breaker bar, or breaker edge 14 extending centrally over the full length of the base 12. The base 12 typically rests on a generally horizontal support surface. The breaker bar 14 projects a predetermined distance above the top surface 16 of the base 12 as shown in FIG. 3. On both sides of the breaker bar 14 and extending substantially over the entire upper surface 16 of the base 12 are pads 18, 20, which help support a tile 22 to be cut. The pads 18, 20 may be made of any material that provides resilient support for the tile 22 during the scoring and breaking process.

The tile cutter 10 further includes alignment blocks, for example, a fixed alignment block 24 and an adjustable alignment block 25. The tile is placed against the alignment blocks and held during the scoring and breaking process. End supports 30, 32 have one end rigidly connected at each end of the base 12 and extend in a generally perpendicular direction away from the top surface 16 of the base 12. A pair of guide rails 34, 36 are connected to guide rail supports 38, 40, which are connected to the other end of the end supports 30, 32. The guide rails 34, 36 are mounted to be substantially parallel to the breaker bar 14 on the base 12. A carriage 42 is slidably mounted on the guide rails 34, 36, and a manually operated lever 44 is pivotally connected to the carriage 42 at a first point 46, which is below the elevation of the guide rails 34, 36. A cutting tool, or scoring wheel 48 is rotatably mounted to the lever 44. After a tile is located on the base 12 such that the scoring wheel 48 is aligned with a line on the tile where a desired cut is to be made, the lever 44 is manipulated to bring the scoring wheel 48 in contact with the top surface 50 of the tile 22. A downward pressure is applied to the handle 44 while the handle 44 and carriage 42 are slid on the guide rails 34, 36, thereby cutting or scoring a small groove 49 in the top surface 50 of the tile 22. After the tile is scored, the carriage 42 is moved toward the end 30; and the lever is manipulated to move the pressure pads 52, 54 into contact with the top surface 50 at one end of the tile 22 by manipulating the lever 44. Thereafter, the lever is pushed down, and the pressure pads 52, 54 apply forces at two points on the top surface 50 of the tile 22, the two points being equally spaced and on opposite sides of the breaker bar 14. Continued downward pressure on the lever 44 will cause the tile 22 to fracture along the scored groove 49.

Referring to FIG. 3, the construction of the preferred embodiment of the invention is shown in more detail. The carriage 42 has shoulders 58, 60, which contain respective guide rail bores 62, 64. Each of the guide rails bores 62, 64 have respective cobores 66, 68 which are sized to receive respective bearings 70, 72. As shown in FIG. 2, at the inner end of the cobore 68, the guide rail bore 64 tapers as it extends longitudinally through the guide rail or to the other end 74 of the carriage 42. The guide rail bore 64 is sized at the end 74 of the carriage 42 to slidingly mate with the guide rail 36.

The carriage 42 further includes opposed identical projections 76, 78 which extend generally perpendicularly from respective shoulders 60, 58 toward the base 12. The opposed projections 76, 78 contain slots 75, 77 having respective opposed first slot portions or first openings 80, 82. Slot portion 80 is also shown with respect to projection 76 in FIG. 2. The first slot portions 80, 82 are sized to slidingly receive the ends of a pin 90, which is connected to and extends from both sides of one end 92 of the lever 44. The first slot portions 80, 82 have respective support surfaces 94, 96, which are directed toward the base and which are formed to receive one end of the pin 90. Therefore, the pin 90 operates as a fulcrum, and the support surfaces 94, 96 function as fulcrum support surfaces to hold the pin stationary when a force is applied downward on the lever 44.

The lever 44 also contains a forked end 98. The scoring wheel 48 is rotatably mounted on an axle 100, and the ends of the axle are mounted in legs 106, 108 of the forked end 98 of the lever 44. The ends of axle 100 are inserted in opposed notches 102 in the legs 106, 108, one of which is shown in FIG. 2. Consequently, the scoring wheel 48 rotates freely with respect to the lever 44. Each of the notches 102 is open at one end and has an elongated extension 112 which gives the notch a resiliency so that the axle 100 to be inserted and removed from the notches 102 to facilitate changing the scoring wheel 48.

Each of the projections 76, 78 has respective opposed second slot portions, or second openings 114, one of which is shown with respect to projection 76 in FIG. 2. The second slot portions 114 include second support surfaces 118. The first slot portions 80, 82 are connected with the second slot portions 114 in the respective projections 76, 78 by connecting slot portions 122 again as shown with respect to projection 76 in FIG. 2. The first slot portions 80, 82 have first legs 126 extending generally away from the first support surfaces 94 of the first slot portion 80, 82. Second legs 128 of the second slot portions 114 extend generally away from the second support surfaces 118 of the second slot portions 114. The connecting slot portions 122 connects a lower end of the first slot portions 80, 82 to a lower end of the second slot portions 114. The connecting slot portions 122 are sized to slidingly receive the lever pin 90.

In use, the lever handle 44 is manipulated to locate the lever pin 90 in the first slot portions 80, 82. The first slot portions are located a first predetermined distance above the upper surface 16 of the base 12 to accommodate tiles 22 in a first range of tile thickness. When a downward pressure is applied to the lever 44, the support surfaces 94, 96 function as first fulcrum supports that support the lever pin 90 operating as a fulcrum for the lever 44. Therefore, as a downward force is applied to the lever 44, a cutting force is applied to the scoring wheel 48; and the fulcrum support surfaces 94, 96 provide a reactive force holding the lever pin 90 stationary. The vertically downward force being applied by the scoring wheel 48 is a function of the distance between the lever pin 90 and the point of application of the force on the lever 44 and the distance between the lever pin 90 and the axle 100. The described construction of the invention provides a stable consistent operation which allows a tile to be scored easily and consistently.

If it is desired to score a tile of a different thickness, the lever 44 is manipulated to slide the lever pin 90 from the first slot portions 80, 82 through the connecting slot portions 122 to the second slot portion 114. The second support surfaces 118 of the second slot portions 114 function as fulcrum support surfaces to hold the lever pin 90 or fulcrum of the lever 44 in a fixed position a second predetermined distance above the top surface 16 of the base 12. The second slot portions 114 are located at a second predetermined distance from the top surface 16 of the base 12, which is greater than the first predetermined distance between the first slot portions 80, 82 and the top surface 16 of the base 12. Therefore, as shown in FIG. 4, the scoring wheel 48 is supported at a second greater height above the top surface 16 of the base 12, thereby accommodating tiles 22, having a greater range of thickness.

While the invention has been set forth by description of the preferred embodiment in considerable detail, it is not intended to restrict or any way limit the claims to such detail. Additional advantages and modifications will readily appear to those who are skilled in the art. For example, with the preferred embodiment, bearings 70, 72 are located only at the one end of the carriage 42. The bearings 70, 72 are positioned to be generally in line with the first slot portions 80, 82 and the second slot portions 114. Therefore, the sliding interface between the carriage 42 and the guide rails 34, 36 is strengthened; and at the same time, the coefficient of friction between those sliding members is reduced by the use of the bearings 70, 72. That construction facilitates moving the carriage along the rails while a force is applied to the lever 44 in order to score the tile 22. Different bearing arrangements may be utilized between the carriage 42 and the guide rods 34, 36. For example, a bearing may extend through the entire length of the guide rod bores 62, 64. Or, alternatively, bearings may be inserted in each end of the guide rod bores 62, 64, or further, the bearings may be eliminated from the construction.

Figure 4:
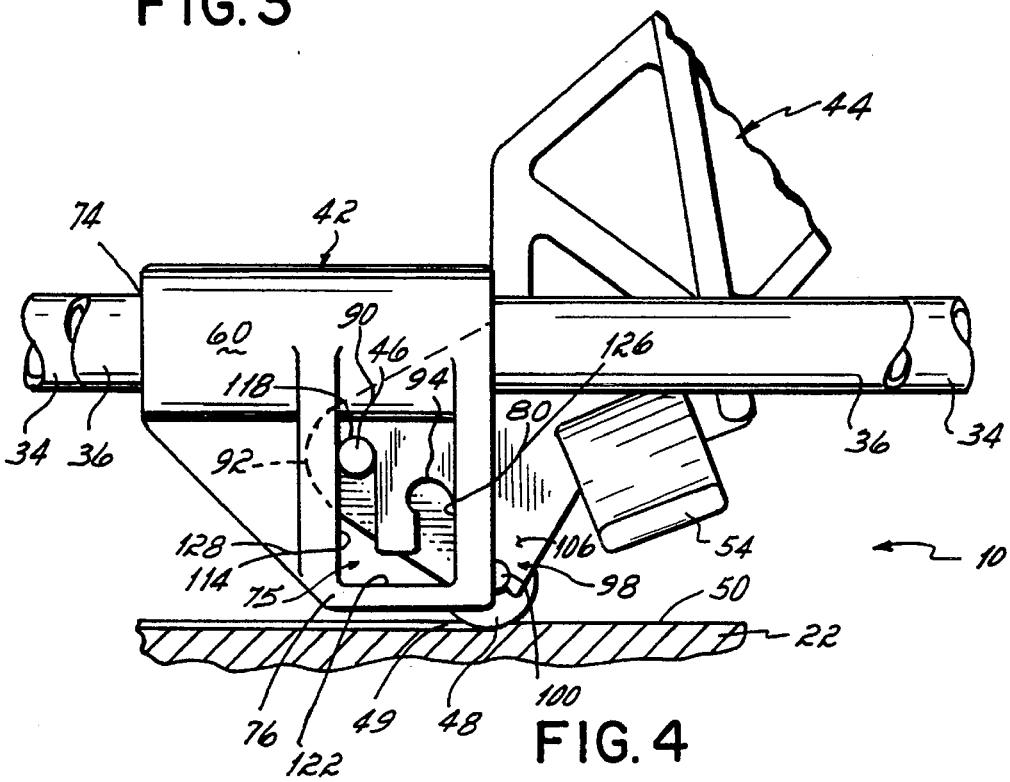
FIG. 4 is a side view illustrating the one end of the lever operatively connected to the carriage at a second height.
Figure 5:
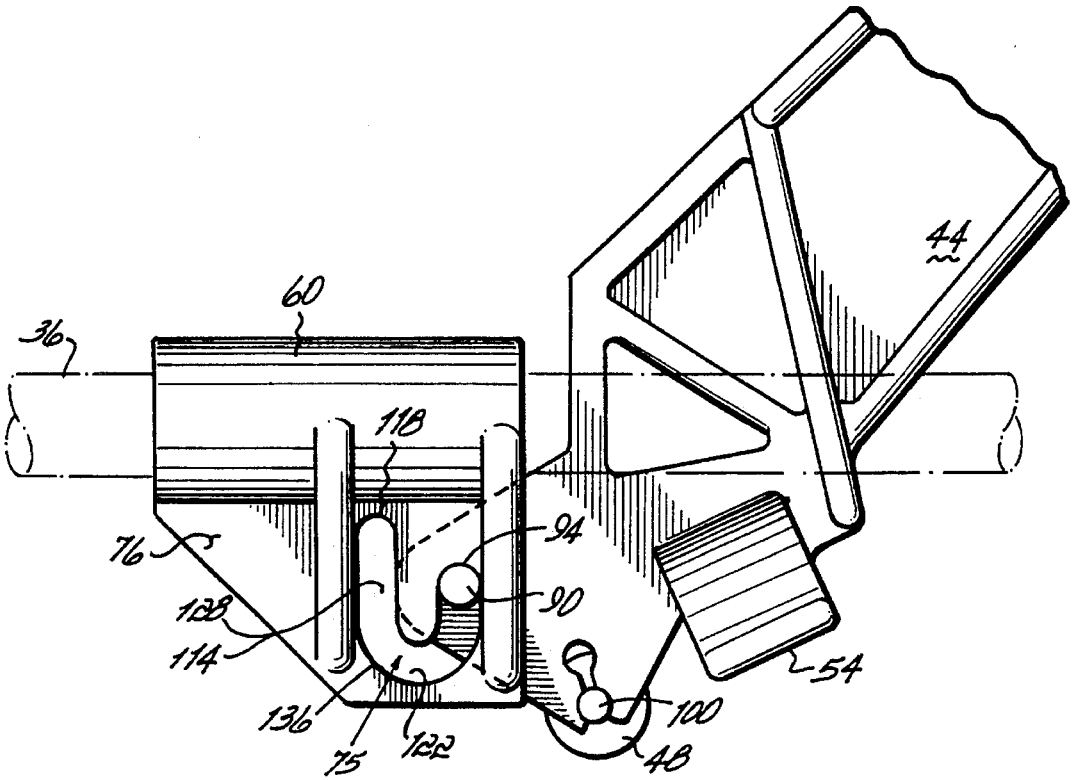
FIG. 5 is a partial side elevation illustrating an alternative slot design on the carriage for moving the scoring wheel between the first and second heights.

As shown in FIGS. 2 and 4, the carriage slot portions 122 connecting the first slot portions 80, 82 with the second slot portions 114 may be generally U-shaped. Alternatively, the connecting slot portion 122 connecting the lower most ends of the first and second slot portions may be moved in a vertically upward direction, thereby forming generally H-shaped carriage slots. Alternatively, each of the connecting slot portions 122 may be replaced by a generally curvilinear slot portion 136 as shown in FIG. 5.

The tile cutter 10 illustrated in FIG. 1 preferably has the base 12 and end supports 30, 32 manufactured from a unitary piece of sheet metal. The rail supports 38, 40, guide rails 34, 36, carriage 42, and lever 44 are preferably manufactured with an injection molding process using a thirty (30%) percent glass-filled nylon. The cutting tool is preferably a rotating scoring wheel, however, other well known mechanisms for scoring the tile may also be used.

The integral construction of the lever and cutting tool on the tile cutter described herein has the advantage of providing excellent rigidity and stability with a simpler, more reliable, and less expensive construction. Further, locating the pivoting connection between the lever and the sliding carriage at a point below the guide rails has a further advantage of providing a more consistent and cleaner scoring action on the upper surface of the tile. Finally, the lever is supported at two selectable pivot points at different heights above the base, thereby permitting the tile cutter to be used with tiles of different thicknesses. The invention, therefore, in its broadest aspects is not limited to the specific details shown and described; and accordingly, departures may be made from such details without departing from the spirit and scope of the invention.

What is claimed is:

1. A manual tile cutter comprising:

a base adapted to support a tile;

a rail connected to the base above the tile;

a carriage slidably mounted on the rail and including a slot having first and second slot portions having first and second fulcrum supports, respectively, located below the rail at first and second predetermined distances, respectively, above the base; said first and second slot portions are laterally spaced with respect to each other;

a cutting tool;

a lever rotatably supporting the cutting tool at one end, the one end of the lever further having a fulcrum located above the cutting tool with respect to the base, and the fulcrum being selectively positioned in the first and the second slot portions and selectively pivotally supported by the first fulcrum support to locate the cutting tool at a first cutting position above the base to score a tile of a first thickness, and the second fulcrum support to locate the cutting tool at a second cutting position above the base to score a tile of a second, different thickness.

2. The tile cutter of claim 1 wherein the fulcrum on the lever comprises a pin connected to the lever, and the first and second slot portions in the carriage are sized to accept a diameter of the pin, each of said slot portions having a fulcrum support surface directed downward toward the base for contacting the pin.

3. The tile cutter of claim 2 further comprising a connecting slot portion sized to slidingly accept the diameter of the pin and connecting the first and second slot portions in the carriage.

4. The tile cutter of claim 3 wherein the connecting slot portion includes a first end intersecting the first slot portion at a location displaced from the support surface of the first slot portion, and the connecting slot portion further includes an opposite second end intersecting the second slot portion at a location displaced from the support surface of the second slot portion.

5. The tile cutter of claim 4 wherein:

the first slot portion extends away from the support surface of the first slot portion in a generally vertically downward direction;

the second slot portion extends away from the support surface of the second slot portion in a generally vertically downward direction; and the connecting slot portion connecting lowermost ends of the first and second slots portions.

6. The tile cutter of claim 3 wherein the connecting slot comprises a single curved slot portion connected to the respective first and second slot portions at locations generally opposite the support surfaces of the first and second slot portions.

7. The tile cutter of claim 1 further comprising a bearing operatively connected between the rail and the carriage at a location generally above the first fulcrum support.

8. The tile cutter of claim 1 further comprising a bearing operatively connected between the rail and the carriage at a location generally above and between the first and second fulcrum supports.

9. The tile cutter of claim 8 wherein the carriage further comprises a bore extending through the carriage and receiving the rail, and further wherein the bearing is located within the bore around the rail proximate one end of the carriage.

10. The tile cutter of claim 9 wherein the bore has a first cross section sized to accept the bearing at the one end of the carriage and the bore has a second cross section at a second end sized to accept the rail.

11. A manual tile cutter comprising:

a generally rectangular base for supporting a tile;

a pair of guide bars mounted to the base with longitudinal axes of the guide bars being generally parallel to a length of the rectangular base;

a carriage member having a pair of bearing surfaces sized to slidingly mate with the pair of guide bars, and a pair of support members spaced apart on a lower surface of the carriage member, each of the support members having a first end connected to said lower surface of said carriage member and, a second end extending in a vertically downward direction toward the base, a slot formed in each of said support members having a first slot portion located a first predetermined distance above the base, a second slot portion located a second predetermined distance above the base greater than the first predetermined distance and laterally spaced from said first slot portion, and a connecting slot portion connecting the first and second slot portions;

a lever having a pin at one end, the pin having ends extending through opposing sides of the lever in a generally horizontal direction, each end of the pin being slidably mounted in the slot in one of the support members of the carriage; and a cutting tool rotatably mounted on the lever proximate the one end of the lever a third predetermined distance above the base less than the first and second predetermined distances, the pin in the lever being selectably movable to a first cutting position above the base to score a tile of a first thickness, and a second cutting position above the base to score a tile of a second different thickness.

* * * * *